United States Patent [19]

Ferrentino

[11] 4,419,157

[45] Dec. 6, 1983

[54] PROCESS AND APPARATUS FOR MANUFACTURING TELECOMMUNICATION CABLES FILLED WITH EXPANSIBLE POWDER

[75] Inventor: Antonio Ferrentino, Monza, Italy

[73] Assignee: Industrie Pirelli Societa per Azioni, Milan, Italy

[21] Appl. No.: 300,263

[22] Filed: Sep. 8, 1981

Related U.S. Application Data

[63] Continuation of Ser. No. 149,467, May 13, 1980, abandoned.

[51] Int. Cl.[3] ..... H01B 13/06

[52] U.S. Cl. ..... 156/56; 57/217; 57/296; 57/362; 156/48; 156/53; 118/44; 118/DIG. 5; 118/DIG. 19; 141/250; 174/102 P; 174/116; 174/118; 427/117; 427/120; 427/185; 428/377; 428/378

[58] Field of Search ..... 156/48, 53, 56; 174/102 P, 116, 118; 141/250; 222/413; 428/377, 378; 57/212, 217, 295, 296, 362; 118/44, DIG. 5, DIG. 19; 427/117, 120, 185

[56] References Cited

U.S. PATENT DOCUMENTS

| | | | |
|---|---|---|---|
| 2,988,249 | 6/1961 | Wahl | 222/413 X |
| 4,002,819 | 1/1977 | Woytiuk | 174/107 X |
| 4,164,245 | 8/1979 | Walling et al. | 141/250 |
| 4,205,515 | 6/1980 | Garner | 156/48 X |

FOREIGN PATENT DOCUMENTS

| | | |
|---|---|---|
| 1036802 | 8/1978 | Canada . |
| 3672 | 8/1979 | European Pat. Off. . |
| 1041121 | 10/1958 | Fed. Rep. of Germany . |
| 458257 | 12/1936 | United Kingdom . |
| 620230 | 3/1949 | United Kingdom . |
| 665418 | 1/1952 | United Kingdom . |
| 724346 | 2/1955 | United Kingdom . |
| 1073958 | 6/1967 | United Kingdom . |
| 1566058 | 4/1980 | United Kingdom . |

*Primary Examiner*—Robert A. Dawson

*Attorney, Agent, or Firm*—Brooks, Haidt, Haffner & Delahunty

[57] ABSTRACT

A process and apparatus for filling multi-conductor cables, particularly a telecommunication cable with several insulated wires surrounded by a covering and a sheath, with a mixture of powders which expand with the absorption of moisture. The conductors are fed in spaced relation into the entrance of a casing having an interior, frusto-conical wall which decreases in diameter from its entrance to its exit. The exit is small in diameter compared to the entrance so that the conductors converge as they pass from the entrance to the exit. Intermediate the entrance and the exit, the conductors are subjected to the powders which are caused to follow a helicoidal course by a screw which directs them toward the exit. Due to the shape of the casing wall, the powders are forced toward the conductors.

13 Claims, 7 Drawing Figures

PROCESS AND APPARATUS FOR MANUFACTURING TELECOMMUNICATION CABLES FILLED WITH EXPANSIBLE POWDER

This is a continuation, of application Ser. No. 149,467, filed May 13, 1980 and now abandoned.

The present invention relates to a process and apparatus for manufacturing telecommunication cables, and particularly, cables comprising substantially a bundle of insulated conductors.

Henceforth, in this text, the term 'conductor' shall mean a conductive wire having insulation thereon, and the term "powdered expansible material" shall include the use of several substances, in the form of powders, which have the characteristic of expanding when subjected, for example, to the absorption of water. Hence, due to this latter characteristic, such powdered expansible material, when introduced between the sheath and the conductors of a telecommunication cable and disposed in such a way as to swell up as a consequence of the entry of water into the cable due to accidental causes produces a blockage which prevents any such water from spreading throughout the entire cable.

As an example of these substances, mixtures of various powders can be mentioned, such as those disclosed in the U.S. Pat. No. 4,002,819 or, yet as another example, carboxymethylcellulose, and bentonite.

Certain of the known cable manufacturing processes are based upon the operation of causing a bundle of conductors, that are already cabled together, to pass into a container having an internal diameter corresponding to that of a bundle, and in sending a mixture of powders by means of pressurized air, towards the annular aperture of the container traversed by the conductors in such a way as to force the powdered material or the powdered mixture in-between the conductors.

This process includes the operation of winding certain tapes around the cable core, for preventing the leakage of the powders, and finally, the step of extruding a protective sheath over the tape covered core.

Unfortunately, during the cabling of the conductors—which is effectuated before these enter into the container, a canal or channel can be formed between the conductors. Consequently, when the conductors pass into the container, there is the drawback that the air, used under pressure at times up to 10 atmospheres, can pass along the canal to the outside of the container, and hence, this could tend to expel the powders that are already introduced in-between the conductors.

A further known process, consists in applying the powdered material electro-statically in-between the conductors before assembling them together. This procedure has the drawback of being rather slow, and moreover, the structure is unsuited for processing in the standard cabling machines used for the actual manufacture of telecommunication cables.

Moreover, the powder disposed on the conductors results, in certain cases, in being insufficient with respect to the quantity that is desired, and the further operation of predisposing oil in the surface of the conductors, for permitting the deposition of the powders, in the successive electrostatic phase brings about, as is known to those skilled in the art, damage to the conductor insulation, due to the presence of the oil when the cable is subjected to electrical tension.

Therefore, one object of the present invention, is to provide a process and apparatus for manufacturing telecommunication cables, which comprise expansible material in powder form, said process or apparatus not having any of the above-mentioned drawbacks.

In accordance with the object of the present invention, the process for manufacturing a telecommunication cable, comprising a bundle of conductors, a covering sheath disposed around the conductors, and material in expansible powder form disposed in-between sheath and conductors, is characterised by the fact of comprising the steps of:

(a) causing the conductors to advance inside means having a truncated-cone shaped cavity, means extending all around the longitudinal axis of the cavity, from an entrance section to an exit section, while maintaining the conductors separated, one from the other, but converging as they move towards the exit section;

(b) causing the material in powder form to advance under pressure, according to a helicoidal course, with mechanical thrusts, for urging said material in powder form in-between the conductors as they pass through the truncated-cone shaped cavity; and (c) covering the conductors with a sheath, upon their exiting from the said cavity.

The distinguishing characteristic of the above-described process, is the guiding and the remixing, under pressure, of powders inside a helicoidal channel, from which the said powders issue and are subjected to a mechanical thrust which suffices to cause them to become well-distributed around and in-between the conductors.

In one form of operation, the process is characterized by the fact of causing the said material in powdered form to advance between the entry and the exit sections of the cavity, along a helicoidal course disposed all around the conductors, and to move said powdered form material from the helicoidal course towards the centre of the cavity, and around the conductors themselves.

A further object of the invention, is an apparatus for manufacturing a telecommunication cable, comprising a bundle of conductors, at least one sheath covering the conductors exteriorly, material in expansible powder form in-between the the bundle of conductors, said apparatus being characterized by the fact of comprising means for helicoidally advancing the material, in expansible powder form, into a truncated-cone shaped cavity having an entry and an exit section and means for separately guiding each conductor into the cavity causing them to converge in a direction towards the cavity exit.

Said frusto-conical cavity, in which the conductors advance separately, can be the same cavity wherein the powders advance in helicoidal fashion.

In this form of realization, the apparatus is characterized by the fact that said means for advancing the material in powder form along a helicoidal course comprises a frusto-conical casing, a hopper for the entry of the material in powder form into the inside of the casing, a hollow screw disposed inside of the casing and having a helicoidal thread that rotates around its own axis, said thread having an external profile in proximity to and along the casing surface and an inner profile defining the limits of a frusto-conical chamber into which the conductors pass, and means for rotating the screw itself.

Other objects and advantages of the present invention will be apparent from the following detailed description of the presently preferred embodiments thereof, which description should be considered in conjunction with the accompanying drawings in which.

Figure 3A:
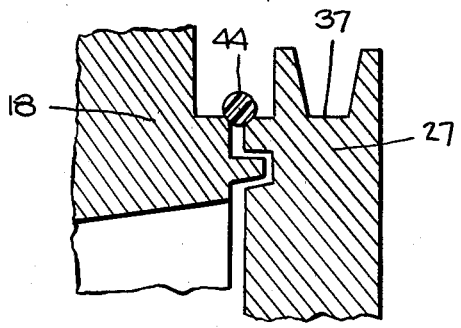
FIG. 3 is an enlarged, longitudinal section of a portion of the apparatus of the plant shown in FIG. 2 for the introduction of the powders into the cable.
Figure 3:
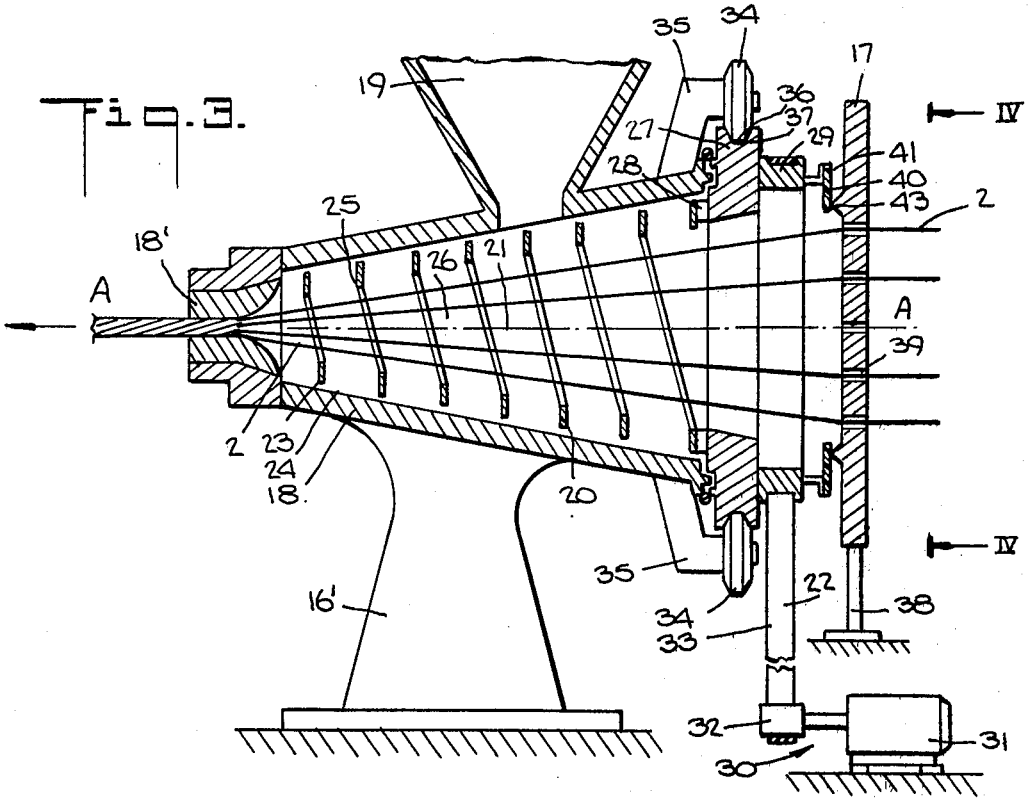
Figure 4:
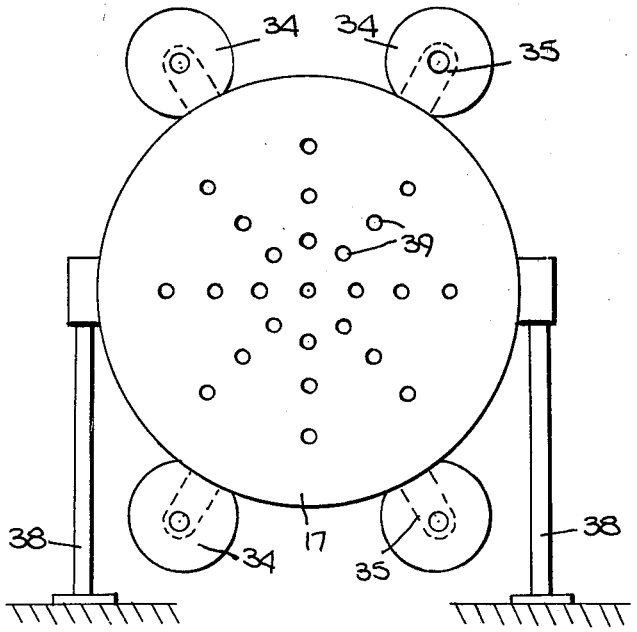
Figure 5:
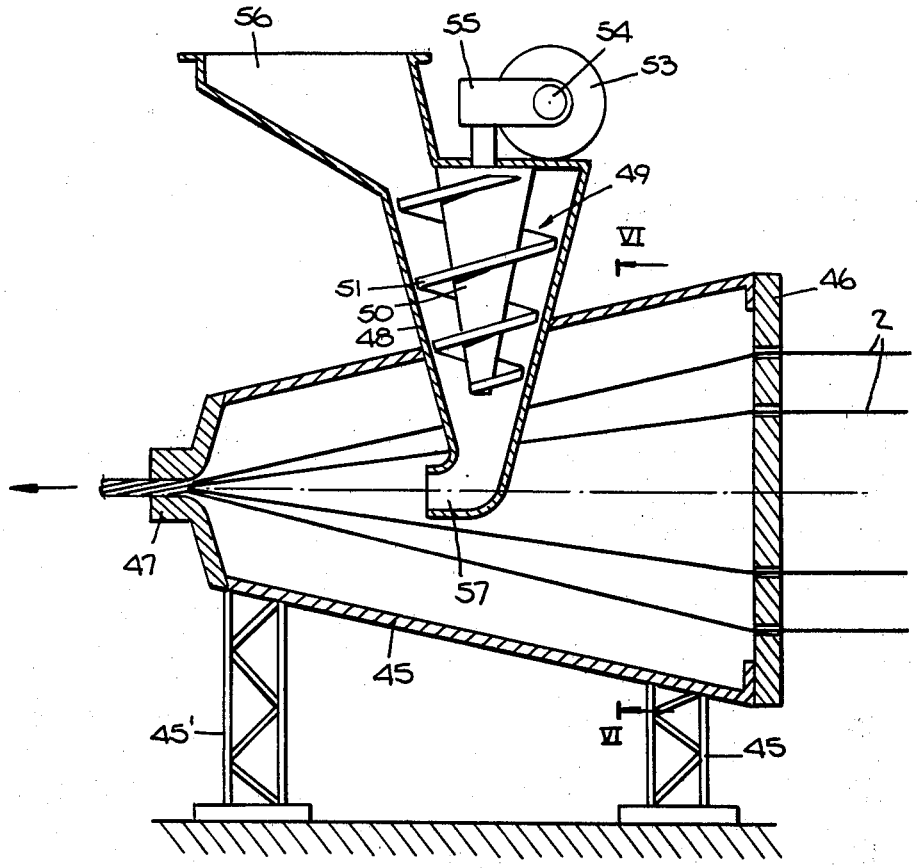
Figure 6:
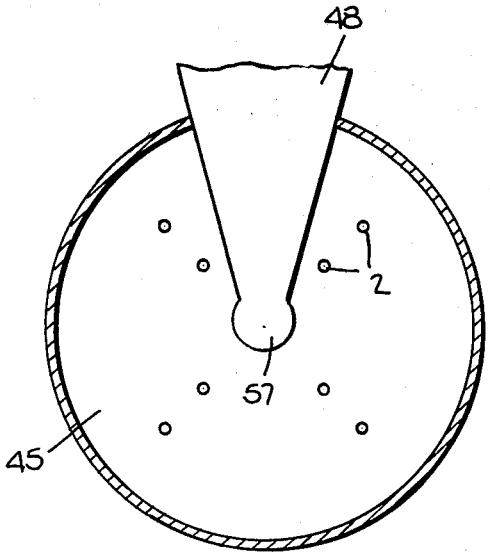

FIG. 3*a* is a cross-sectional detail of a portion of the apparatus shown in FIG. 3, FIG. 4 is an end of the apparatus shown in FIG. 3 as viewed from the line IV—IV shown in FIG. 3, FIG. 5 is a longitudinal section of an alternative embodiment of the powder apparatus of the invention wherein the means for advancing the powders is separated from the cavity through which the conductors pass, and FIG. 6 is a cross-sectional view of the apparatus shown in FIG. 5 and is taken along the line VI—VI shown in FIG. 5.

Figure 1:
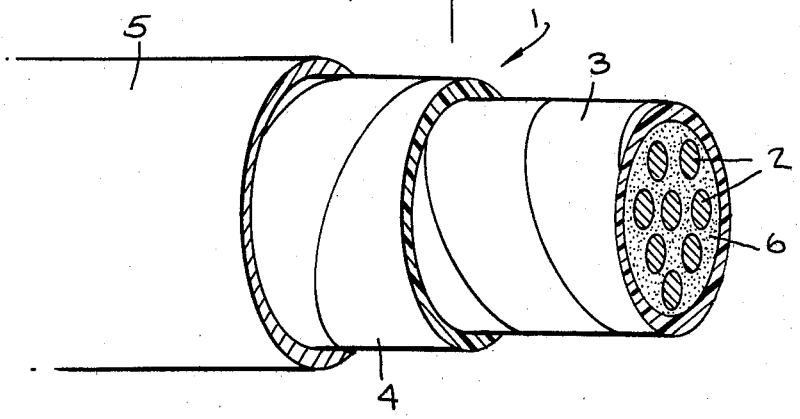
FIG. 1 is a fragmentary perspective view of a cable, manufactured according to the invention.

The invention will now be described with reference to the manufacture of a telecommunication cable 1 (FIG. 1) comprising a plurality of conductors 2, insulated—for example, with thermoplastic resins, such as polyolefins or vinylic resins, two spiralled overlapped tapes 3,4 an external sheath 5 of metal, plastics or rubber, expansible material 6, in the form of powder and in-between the conductors 2 and between the conductors 2 and the tapes 3.

For example, the tapes may be made of polyester, the sheaths, polyethylene, and the expansible material comprises carboxyl-methyl-cellulose.

In a particular cable constructed according to this invention, the inter-spaces between the conductors and around the conductors, can be filled at least partially, by means of a suitable dosage, with the expansible material adapted for forming a blockage against any penetration of water. For example, this material can occupy 30% of the spaces present in the cable-core, and then if there be any present water, the material will swell and thus, block the water from spreading along the cable.

The apparatus 7 (FIG. 2) for the manufacture of cable 1, comprises a station 8 with a plurality of bobbins 9 around which are wound the conductors 2, a group 10 of the guide-pulleys 11 for the conductors 2 during the unwinding, an apparatus 12 for the application of the expansible material, a group 13 for applying spiralled tapes 3 and 4 around the cable-core, an extruder 14 for covering the core with the sheath 5, a winching drum 15, and a drum 15' for collecting the cable.

The drums 15 and 15' respectively, rotate around their own axis for pulling and collecting the cable, and simultaneously, they also rotate around the axis A-A for causing, in a known way, the cabling of the conductors 2 at the exit of the apparatus 12.

The principal part of the invention, is constituted by an apparatus 12, and the other parts of the apparatus 7 are constituted by known devices and hence, hereinafter, for simplicity sake, these known devices will simply be mentioned whenever necessary.

The apparatus according to the main concept of the invention, is based upon means adapted to urge the material 6 in powder form (FIG. 1) forward and along a helicoidal path within a frusto-conical cavity defined by two sections and upon further means for guiding the conductors 2 separately, one from the other, into the cavity.

In a preferred form of embodiment, these means are constituted respectively, by an Archimedean screw device 16, that rests upon a base 16' (FIG. 3) and by a special element 17, referred to hereinafter as the 'die'.

The spiralling device 16 comprises a frusto-conical casing 18, a hopper 19 for the entry of the expansible material, in powder form, towards the inside of the casing 18, a hollow screw 20 disposed within the casing 18 and having a helicoidal thread rotating around its own axis 21 that coincides with the axis A-A of the plant and means 22 for rotating the screw 20. The exit of the casing 18 comprises a plug 18', preferably made out of stainless steel, and having a central hole for the passage of the conductors 2.

Said helicoidal thread of the screw 20 is disposed with its external profile 23 in proximity to, and extending along the inner surface 24 of, the casing, and with its inner profile 25 defining a frusto-conical chamber 26, inside which the conductors 2 pass and which is in communication with the spaces between the threads of the screw 20.

The means 22 for the rotation of the screw, comprise an annular flange 27 secured to the right extremity 28 of the helicoidal thread in the proximity of the entry section of the conductors 2 into the casing 18, a pulley 29 open at its center and connected laterally to the flange 27, and a driving group 30 comprising a motor 31, a pulley 32 and a belt 33 which drives the screw 20 by way of the pulley 32 and the pulley 29 respectively.

The screw 20 is supported and centered with respect to the casing 18, by suitable supporting means which, in the preferred embodiment comprises a plurality of rollers 34 on the arms 35 extending from the casing 18 with the axis of each roller 34 parallel to the axis 21 of the screw 20, the rollers 34 being distributed around the periphery of the flange 27 (see FIGS. 3 and 4).

Each of said plurality of rollers 34 presses, at its periphery 36, against the wall of a special annular well 37 of the flange 27 in such a way that the rollers 34 are caused to rotate by the flange 27 itself, and these rollers 34 prevent any mis-alignment of the screw 20 with respect to the casing 18.

The entry section of the Archimedean screw device 16, is limited by the die 17 sustained by a structure 38 and provided with a plurality of holes 39, distributed along circles of various diameters, the conductors 2 passing through the holes 39.

The apparatus 12 is completed by the presence of sealing means between the stationary die 17 and the face of rotating pulley 29. These sealing means can be several, and they are made out of materials which are adapted to be sealed in fixed relation either to the pulley 29, or to the die 17, in such a manner that during the relative motion between pulley 29 and die 17, there is a sliding contact and simultaneously a sealing. For example, this material can be comprised of an elastomeric annular gasket 40 having its periphery 41 attached to the pulley 29, and in a lip-sealing contact with a circular protuberance 43 on the die 17 and having a pointed edge engaging the gasket 40.

The apparatus further includes a sealing means between the casing 18 and the opposed rotating pulley 27, for example, an annular elastomeric gasket 44 applied, as is shown in FIG. 3*a*, in contact with the surfaces of the casing 18 and of the pulley 27 and preferably, chrome plated for reducing friction to the minimum.

Upstream and downstream of the apparatus 12, suitable containers (not illustrated) may be attached for receiving and holding, if necessary, small quantities of powder which can come out nevertheless, from the apparatus 12.

The sealing means, made as described, prevents almost all of the powder material from escaping thereby permitting the elimination of any subsequent operations for the recovery of such material, and more important still, maintaining the air surrounding the apparatus practically free of great quantities of powder dispersed therein. In this manner the health of the workers is also safeguarded.

The operation of the apparatus will now be described. The conductors 2 (FIG. 2), subjected to the pull exercised by the drum 15, are gradually unwound from the bobbins 9 and guided from group 10 of pulleys 11 toward the screw device 16 of FIG. 3. The conductors 2, which are separated one from the other as they enter the device 16 converge within the device 16 owing to the action of the separating and guiding that is imposed upon them by the holes 39 (FIG. 4) of the die 17 through which they pass and to the cabling action to which they are subjected when exiting from the casing 18.

During their passage through the screw device 16, the various conductors 2 cross the frusto-conical chamber 26, remaining inside the helicoidal threads of the screw 20 that is rotated around its axis 21 by means of the driving group 30 (FIG. 3).

The screw 20 continuously pushes the expansible material 6, loaded in powder form into the hopper 19, toward the plug 18' along a helicoidal course or path and as the powders gradually approach the exit at the left extremity of the casing 18, they are forced to occupy even smaller volumes with the result that the powders are forced inwardly toward the axis 21. As a consequence, said powders fully penetrate in-between the conductors. This action is further favoured by the fact that the conductors 2 are squeezed together as they move towards the exit, with the result of compressing and more tightly enclosing the powders within the bundle of conductors 2.

Thereafter, as the bundle of the conductors 2, containing the powdered material, issues from the Archimedean screw device 16, there takes place the further and following usual steps for manufacturing the cable 1 (FIG. 2):

(1) firstly, the cabling of the conductors is effectuated by rotating the drums 15 and 15' around the axis A-A;

(2) then, the tapes 3 and 4, are applied by means of the group 13;

(3) thereupon, the cable-core is covered with an external protective layer 5, by means of the extruder 14;

(4) finally, there takes place the winding of the cable under the form of turns—with the help of the winch drum 15 and the collecting drum 15.

One particular advantage of the apparatus just described, lies in the possibility of filling-up the interspaces between the conductors, with powders even when, for some reason or other, the feeding of the material 6, by way of the hopper 19, is interrupted. In fact, inside the casing 18, within which the screw rotates, there is deposited a certain quantity of powder 6 having a volume that is higher than that immediately required by the bundle of conductors 2 exiting from the apparatus. Consequently, the screw 20 is able to push, for a certain period, this powdered material 6 independently of the feed of the powder from the hopper 19 towards the exit, in this way guaranteeing (at least for the period sufficient for the hopper to be refilled) a correct manufacturing of the cable.

In a further embodiment according to this invention, the apparatus for applying the powders comprises means separated from the frusto-conical cavity where the conductors 2 pass for pushing the powdered material into the cavity. With reference to FIGS. 5 and 6, such means include:

(a) a first frusto-conical casing 45, resting on the base 45', inside which the conductors 2 pass separatedly, while being dragged by appropriate pulling means (not illustrated) from the entry section—represented by a die 46, to the exit section 47 of the casing;

(b) a second frusto-conical casing 48, inside which a frusto-conical screw 49 rotates, the screw 49 having a full-core 50 and a thread 51. Said screw 49 is rotated around its own axis 52 by a motor 53 through a known per se connection means 54 and 55 which may, for example, be an end-less screw 54, and gears within a casing 55 for rotating the shaft of screw 49.

This second casing 48 is fed with expansible material in powder form coming from a hopper 56 and comprises at its exit, an extension 57, the end section of which lies between the conductors 2 of the bundle adjacent to the section exit 47 of the casing 45, or in a more distant position the feed of the powders being varied as a function of the position of the end section of the said extension 57 with respect to the conductors 2 that are convergent one to the other.

Preferably, the first casing 45 further comprises adequate systems for the exhausting of a part of the powders when the pressure, to which they are subjected inside this casing in the vicinity of the hole in the exit section 47, becomes excessive and may cause a risk of bringing about a rupture of the conductors 2 themselves.

For example, the apparatus could be provided with an exhaust valve that is set for a pressure value of the powder. Alternatively, it could comprise a conduit between the first casing 45 and the hopper 56 in such a way as to return a certain quantity of powders to the hopper 56, and in this manner, to maintain the pressures of the powders in the vicinity of the exit 47 at correct functioning values.

Figure 2:
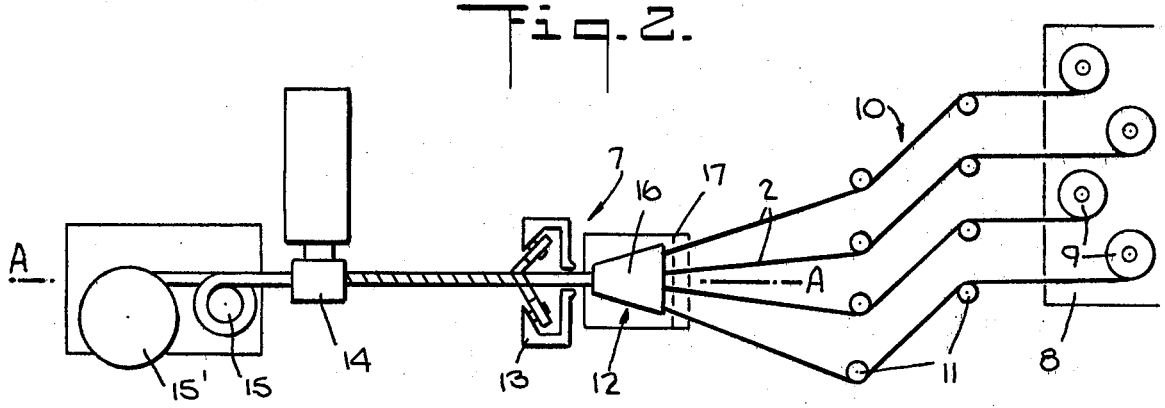
FIG. 2 is a longitudinal diagrammatic view of a plant for manufacturing the cable of FIG. 1.

The apparatus of FIGS. 5 and 6, forms part of apparatus for manufacturing a cable (FIG. 1), which is illustrated in FIG. 2 and is a substitute for the apparatus 12. Even in this embodiment, the powders are forced to follow a helicoidal course, caused by the turns of the screw 49 at the exit from the extension 57, with a mechanical thrust that pushes the powders towards the exit 47 and the frusto-conical part of the casing 45 having a diminishing diameter.

Let it be assumed that the casing 45 is half-filled with expansible material in powder form. As a consequence of the continuous rotation of the screw 49, there is a further inflow of powders coming from the hopper 56 and directed from the exit section of the extension 57 in such a way as to continually fill the upper free space in the proximity of the exit section 47 of the casing 45, thereby providing a mass of powders, in the form of a frusto-conical 'block' inside which the conductors 2 pass.

The solutions provided by the present invention prevent the formation, in the powders accumulated in the vicinity of the exit of the casing, of canals or channels caused by the passage of the conductors 2, such canals having walls delimiting areas having sections that are greater than the transverse dimension of the conductors. This situation, if occuring, would become extremely undesirable since the conductors 2 would pass through the canals without receiving or dragging the powders along with them.

The solutions illustrated in the FIGS. 3 and 5 eliminate to good advantage, these drawbacks. In fact, the continuous inflow of the new quantities of powders—pushed by the screw 20 (FIG. 3) or by the screw 49 (FIG. 5) causes the collapsing and the continuous remixing of the canal walls which may be formed by the passage of the conductors and therefore, this guarantees the contact and the dragging of the powders among the conductors.

Although preferred embodiments of the present invention have been described and illustrated, it will be apparent to those skilled in the art that various modifications may be made without departing from the principles of the invention. For example, the invention is applicable to telecommunication cables having parts that are different from those which are described and illustrated in FIG. 1. Also, for example, the screw 30 can have a single or a multiple-thread, as desired.

The embodiments of the invention in which an exclusive property or privilege is claimed are defined as follows:

1. A process for manufacturing a multi-conductor, electric cable comprising a plurality of conductors bundled together, a covering over the bundled conductors, and a material expansible by the absorption of a liquid disposed between the conductors and between the conductors and the covering, said process comprising:

advancing a plurality of said conductors through a frusto-conical casing having guiding means forming a first wall at the larger diameter end and an inner frusto-conical wall, said casing having a conductor entrance in the first wall at the larger diameter end of said frusto-conical wall and a conductor exit at the smaller diameter end of said frusto-conical wall, said conductors being advanced in the direction from said entrance to said exit, being fed into said entrance in spaced relation and being maintained in spaced relation until they are brought together in converging relation at said exit whereby the conductors effectively form an open frusto-conical cage within said casing having its larger end at said entrance and its smaller end at said exit;

at a point spaced from said exit in the direction of said entrance, supplying said material in powder form to the interior of said frusto-conical wall of said casing and to the interior of said frusto-conical cage while the conductors are advanced, and within said frusto-conical wall, mechanically causing said material in powder form to flow from said point along a helicoidal course within said frusto-conical wall and in said direction in which said conductors are advanced independently of the movement of the conductors, said conductors being exposed within said frusto-conical wall to said powder supplied therewithin and said helicoidal course also being directed so as to intersect the spaced conductors within said frusto-conical wall and so as to pass between the spaced conductors within said frusto-conical wall whereby said material is directed onto and between said conductors within said frusto-conical wall and enters and fills the frusto-conical cage formed by the spaced conductors and advances therewithin and toward said exit at which the material is forced toward the axis of said casing and further penetrates between the conductors; and when the conductors with the powder thereon and therebetween leave said exit, applying a covering thereover.

2. A process as set forth in claim 1 wherein said helicoidal course extends around said plurality of conductors and powder is diverted from said course throughout its length toward said conductors.

3. A process as set forth in claim 1 or 2 wherein said covering is applied by wrapping the conductors with tapes and applying a sheath over the wrapped tapes.

4. Apparatus for manufacturing a multi-conductor, electric cable comprising a plurality of conductors bundled together with a material expansible by absorption of liquid disposed on and between the bundled conductors, said apparatus comprising:

a frusto-conical casing having a larger diameter entrance end, a smaller diameter, exit end and a frusto-conical inner wall, a conductor entrance opening at the larger diameter end of said wall and a conductor exit opening, smaller than the entrance opening, at the smaller diameter end of said wall;

means for advancing said conductors through the cavity defined by said wall in the direction from said entrance opening to said exit opening;

guiding means for guiding said conductors in spaced relation at the entrance end of the casing for maintaining the conductors in spaced relation until they are at the exit end of the casing and for bringing the conductors into close relation at the exit end of the casing, where said conductors effectively form a frusto-conical cage within the casing having its larger end at said entrance end and its smaller end at said exit end; and means for supplying said expansible material in powder form to the interior of said casing at a point spaced from said exit end in the direction of said entrance end and onto and between the spaced conductors within said casing, said casing being free of obstructions between said last-mentioned means and said conductors within said casing which would prevent said material in powder form from impinging upon said conductors within said casing and from passing therebetween into the cage formed within said casing by said conductors and said last-mentioned means including means within said frusto-conical inner wall of said casing for causing said expansible material in powder form to flow along a helicoical course within said frusto-conical wall from in advance of said exit opening and toward said exit opening, said helicoidal course also intersecting said conductors and passing therebetween.

5. Apparatus as set forth in claim 4 wherein said means for causing said material to flow along a helicoidal course comprises a screw within said frusto-conical inner wall with a longitudinal bore and with spaced threads around said bore having openings therebetween which extend from the exterior of the screw to said bore, said screw extending longitudinally from adjacent the exit opening to a point spaced from said exit opening in the direction of said entrance opening, said screw being rotatably mounted and said threads having a hand which causes said material to move in the direction from said entrance to said exit when the screw is rotated in one direction, said bore of said screw being sized and shaped to permit the passage of said conductors therethrough and the outer peripheries of said threads conforming and being adjacent to said wall, driving means for rotating said screw in said one direction around its longitudinal axis, and a hopper for feeding said material into said cavity at a point therein spaced from said exit opening.

6. Apparatus as set forth in claim 5 wherein said bore is frusto-conical and has its smaller and larger diameter ends respectively adjacent said exit opening and spaced from said exit opening in the direction of said entrance opening.

7. Apparatus as set forth in claim 6 wherein said driving means comprises a flange ring, mounting means rotatably mounting said ring at the entrance end of said casing, the inner diameter of said ring being a size which permits the passage of said conductors therethrough and said screw being secured at the end thereof nearest said entrance opening to said ring for rotation with the latter, and power actuated means connected to said ring for rotating said ring around the axis of said screw.

8. Apparatus as set forth in claim 4, 5 or 6 wherein said guiding means comprises a disc with a plurality of circumferentially spaced openings for the passage of the conductors through said openings.

9. Apparatus as set forth in claim 4 wherein said means for causing said expansible material to flow along a helicoidal course comprises a further casing having a frusto-conical inner wall and having an extension at the smaller diameter end of the wall thereof disposed within said cavity intermediate the entrance and exit openings of said first-mentioned casing, said extension having an exit opening directed toward the exit opening of the first-mentioned casing for directing said material toward said last-mentioned exit opening, a screw within said further casing, said screw being rotatably mounted within said inner wall of said casing, having its axis of rotation extending transversely to the axis of the frusto-conical wall of said first-mentioned casing and having exterior threads shaped to conform to the shape of said last-mentioned inner wall and to lie in close proximity to said last-mentioned inner wall, and means for feeding said material to said screw at a point thereon remote from said extension.

10. Apparatus as set forth in claim 9 wherein said guiding means comprises a disc at the entrance opening of the first-mentioned casing for maintaining the conductors in spaced relation at the entrance opening, said disc having a plurality of circumferentially spaced openings therethrough for the passage of the conductors through said openings.

11. Apparatus for manufacturing a multi-conductor, electric cable comprising a plurality of conductors bundled together with a material expansible by absorption of liquid disposed on and between the bundled conductors, said apparatus comprising:

a frusto-conical casing having a larger diameter entrance end and a frusto-conical inner wall, a conductor entrance opening at the larger diameter end of said wall and a conductor exit opening, smaller than the entrance opening, at the smaller diameter end of said wall;

means for advancing said conductors through the cavity defined by said wall in the direction from said entrance opening to said exit opening;

guiding means for guiding said conductors in spaced relation at the entrance end of the casing for maintaining the conductors in spaced relation until they are at the exit end of the casing and for bringing the conductors into close relation at the exit end of the casing; and means for supplying said expansible material in powder form to the interior of said cavity at a point spaced from said exit in the direction of said entrance and onto and between the spaced conductors, said last-mentioned means comprising a screw within said frusto-conical inner wall of said casing for causing said expansible material in powder form to flow along a helicoidal course within said frusto-conical wall from in advance of said exit opening and toward said exit opening, said screw having a frusto-conical, longitudinal bore and with spaced threads around said bore having openings therebetween which extend from the exterior of the screw to said bore, said screw extending longitudinally from adjacent the exit opening to a point spaced from said exit opening in the direction of said entrance opening, and having the smaller and larger diameter ends of the bore respectively adjacent said exit opening and spaced from said exit opening in the direction of said entrance opening, said screw being rotatably mounted and said threads having a hand which causes said material to move in the direction from said entrance to said exit when the screw is rotated in one direction, said bore of said screw being sized and shaped to permit the passage of said conductors therethrough and the outer peripheries of said threads conforming and being adjacent to said wall, driving means for rotating said screw in said one direction around its longitudinal axis, said driving means comprising a flange ring, mounting means rotatably mounting said ring at the entrance end of said casing, the inner diameter of said ring being a size which permits the passage of said conductors therethrough and said mounting means comprising a plurality of rollers distributed around and engaging the circumference of said ring, said rollers having axes of rotation parallel to the axis of rotation of said screw and said screw being secured at the end thereof nearest said entrance opening to said ring for rotation with the latter, and power actuated means connected to said ring for rotating said ring around the axis of said screw.

12. Apparatus as set forth in claim 11 further comprising sealing means engaging said ring and said guiding means for preventing powder within said casing from exiting therefrom between said ring and said guiding means.

13. Apparatus as set forth in claim 12 wherein said guiding means has a plurality of circumferentially spaced openings therein for the passage of said conductors therethrough, said guiding means being mounted adjacent and in stationary relation to said ring, and wherein said sealing means comprises an annular gasket of elastomeric material mounted for rotation with said ring and engaging said guiding means.

* * * * *